US007308721B1

(12) United States Patent
Rivera, Jr.

(10) Patent No.: US 7,308,721 B1
(45) Date of Patent: Dec. 18, 2007

(54) FACEMASK ASSEMBLY

(76) Inventor: Angel R. Rivera, Jr., 6967 Commerce Ave., El Paso, TX (US) 79915

( * ) Notice: Subject to any disclaimer, the term of this patent is extended or adjusted under 35 U.S.C. 154(b) by 91 days.

(21) Appl. No.: 11/318,008

(22) Filed: Dec. 27, 2005

(51) Int. Cl.
*A42B 5/00* (2006.01)

(52) U.S. Cl. ..... 2/207; 2/9

(58) Field of Classification Search ..... 2/209, 2/207, 9

See application file for complete search history.

(56) References Cited

U.S. PATENT DOCUMENTS 3,594,814 A 7/1971 Schuessler
4,180,868 A 1/1980 Snow
4,272,853 A 6/1981 Schuessler
4,641,379 A * 2/1987 Martin ..... 2/9
4,825,474 A * 5/1989 Edwards ..... 2/206
D311,261 S 10/1990 Avey
D331,300 S 11/1992 Fountain
5,575,009 A * 11/1996 Ryvin ..... 2/173
5,701,609 A 12/1997 Bridges
5,704,068 A * 1/1998 Martin ..... 2/173
5,713,077 A 2/1998 Humbrecht
5,845,340 A * 12/1998 Frislie ..... 2/202
7,188,374 B2 * 3/2007 Carey ..... 2/209.11

* cited by examiner

*Primary Examiner*—Katherine Moran

(57) ABSTRACT

A facemask assembly includes a cloth panel that has a front side, a back side, a bottom edge, an upper edge, a first lateral edge and a second lateral edge. The front side has a generally convex shape. The panel has a plurality of apertures extending therethrough. The apertures are positioned generally between the first and second lateral edges and nearer to the bottom edge than the upper edge. A securing apparatus is attached to the panel and is configured to releasably secure the back side of the panel to an outer surface of a hardhat liner strap.

5 Claims, 4 Drawing Sheets

FACEMASK ASSEMBLY

BACKGROUND OF THE INVENTION

1. Field of the Invention

The present invention relates to facemask devices and more particularly pertains to a new facemask device for attaching to a hardhat liner so that a person wearing the hardhat has their face protected from cold weather by the facemask.

2. Description of the Prior Art

The use of facemask devices is known in the prior art. U.S. Pat. No. 5,575,009 describes a facemask device that includes a strap for extending around a person's head to secure the facemask over the person's face. Another type of facemask device is U.S. Pat. No. 4,180,868 that includes a covering that is extendable completely around the lower back portion of a hardhat and then may be extended across the face of a person wearing the hardhat. A drape apparatus for protecting the neck from sunlight of a person wearing a hardhat is found in U.S. Pat. No. 5,701,609.

While these devices fulfill their respective, particular objectives and requirements, the need remains for a device configured to be removably attached to a strap of a hardhat liner so that the device may be easily positioned over the face of a person wearing the hardhat without requiring the person to remove the hardhat or struggle with extending the device around the hardhat.

SUMMARY OF THE INVENTION

The present invention meets the needs presented above by generally comprising a panel that has a front side, a back side, a bottom edge, an upper edge, a first lateral edge and a second lateral edge. The panel is comprised of an insulating cloth material. The front side has a generally convex shape. The panel has a plurality of apertures extending therethrough. The apertures are positioned generally between the first and second lateral edges and nearer to the bottom edge than the upper edge. A securing apparatus is attached to the panel and is configured to releasably secure the back side of the panel to an outer surface of a hardhat liner strap.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
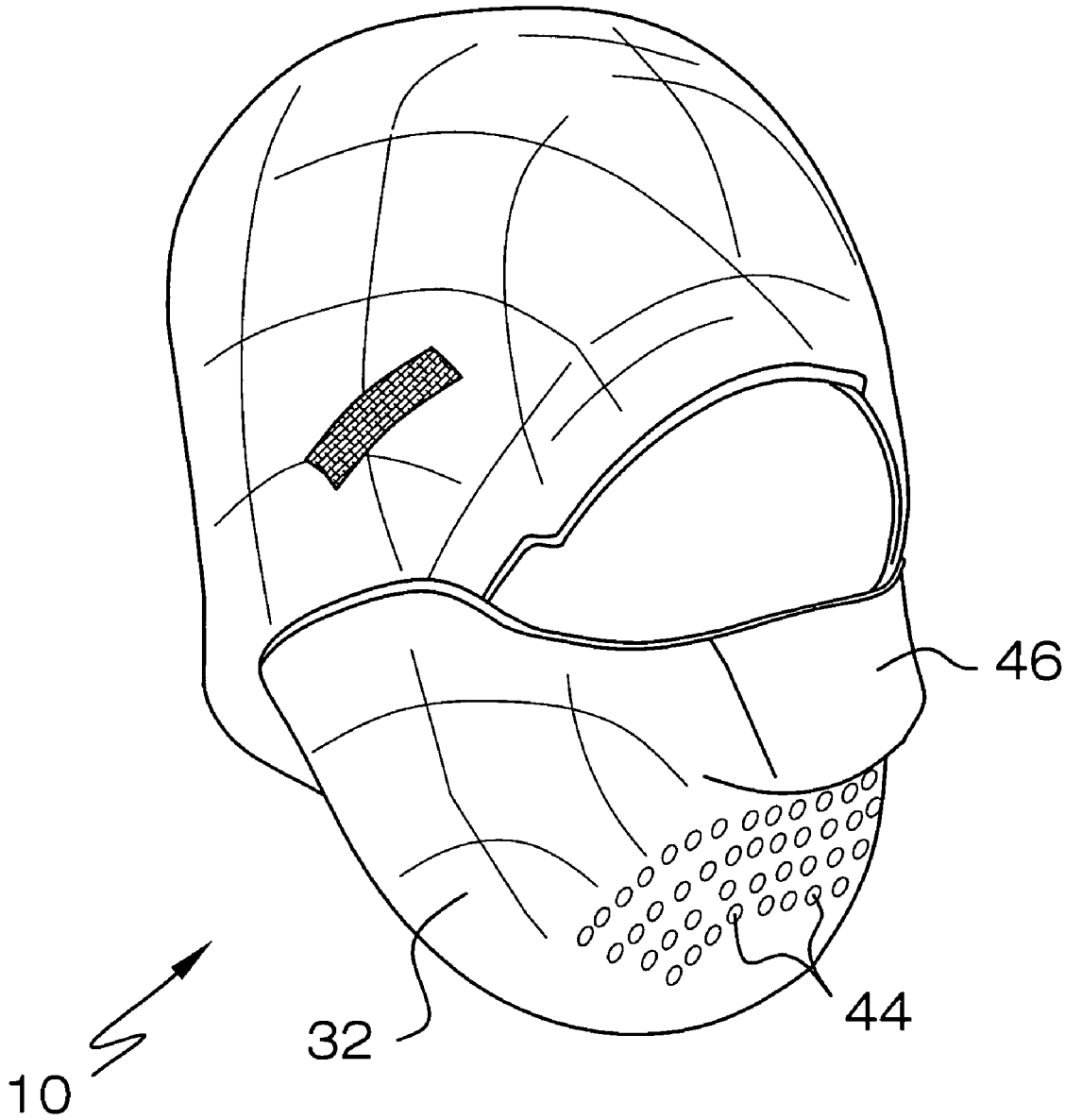
FIG. 1 is a perspective view of a facemask assembly according to the present invention.
Figure 2:
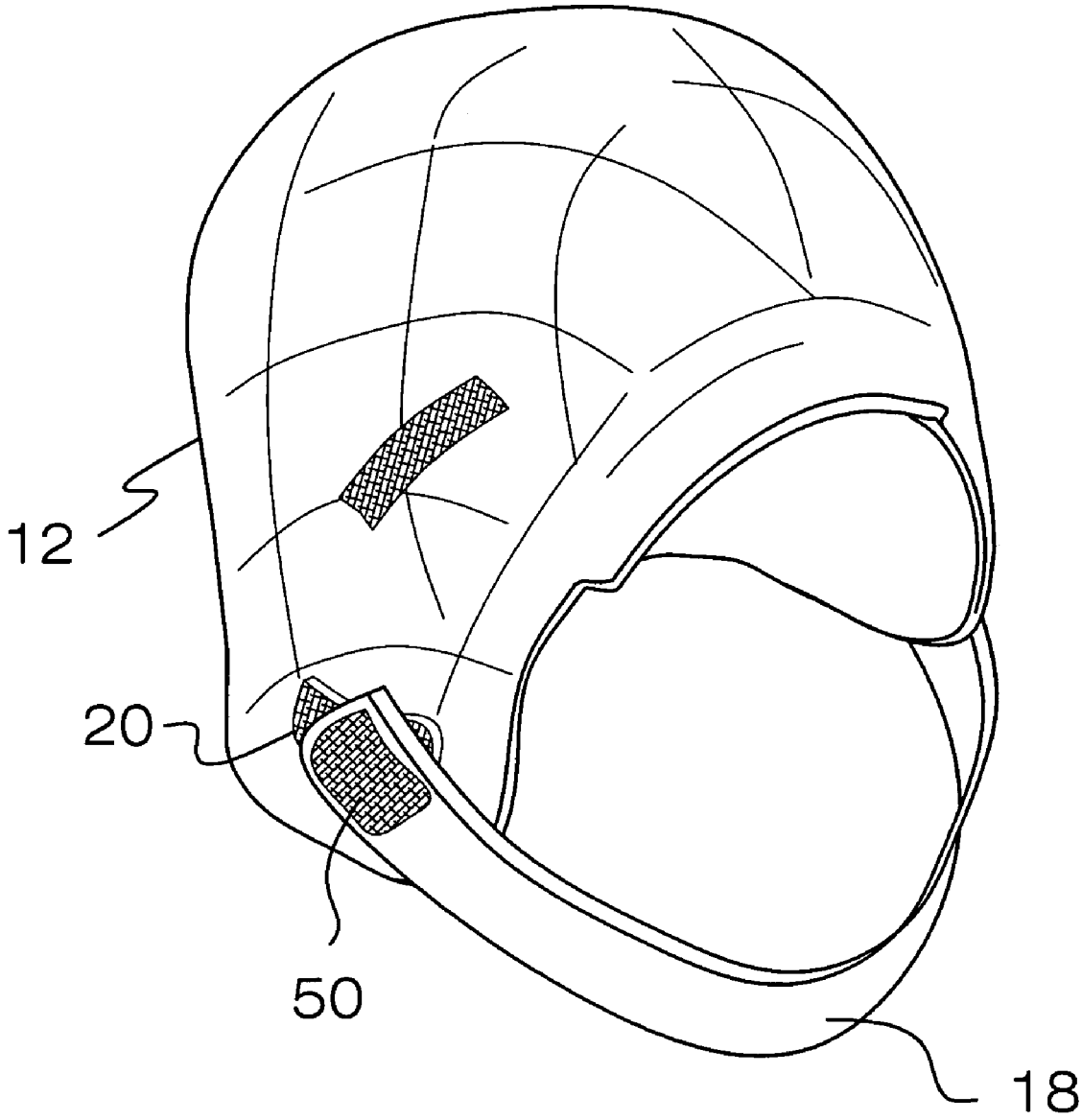
FIG. 2 is a perspective view of a hardhat liner and strap attached thereto.
Figure 3:
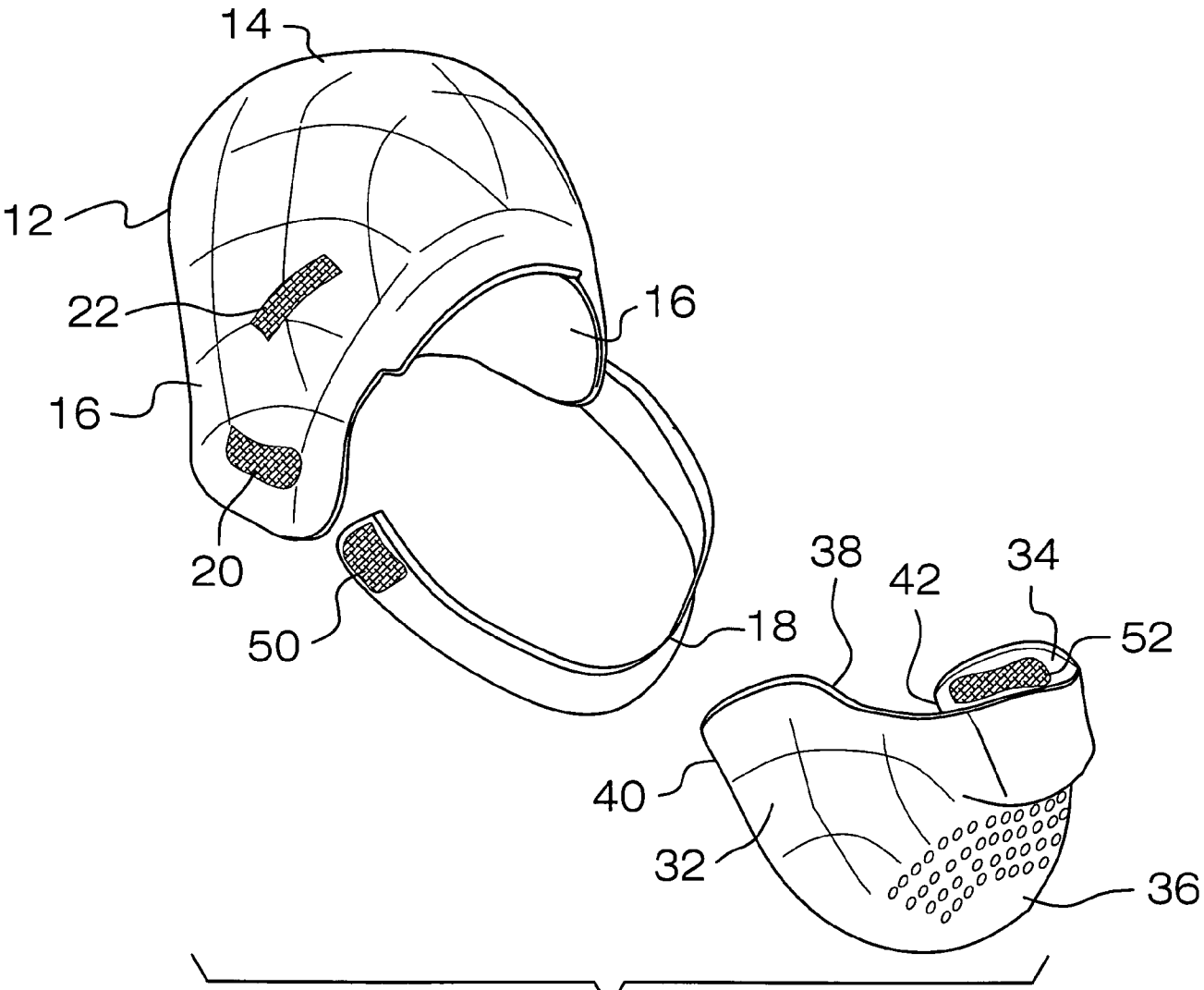
FIG. 3 is a perspective view of the present invention.
Figure 4:
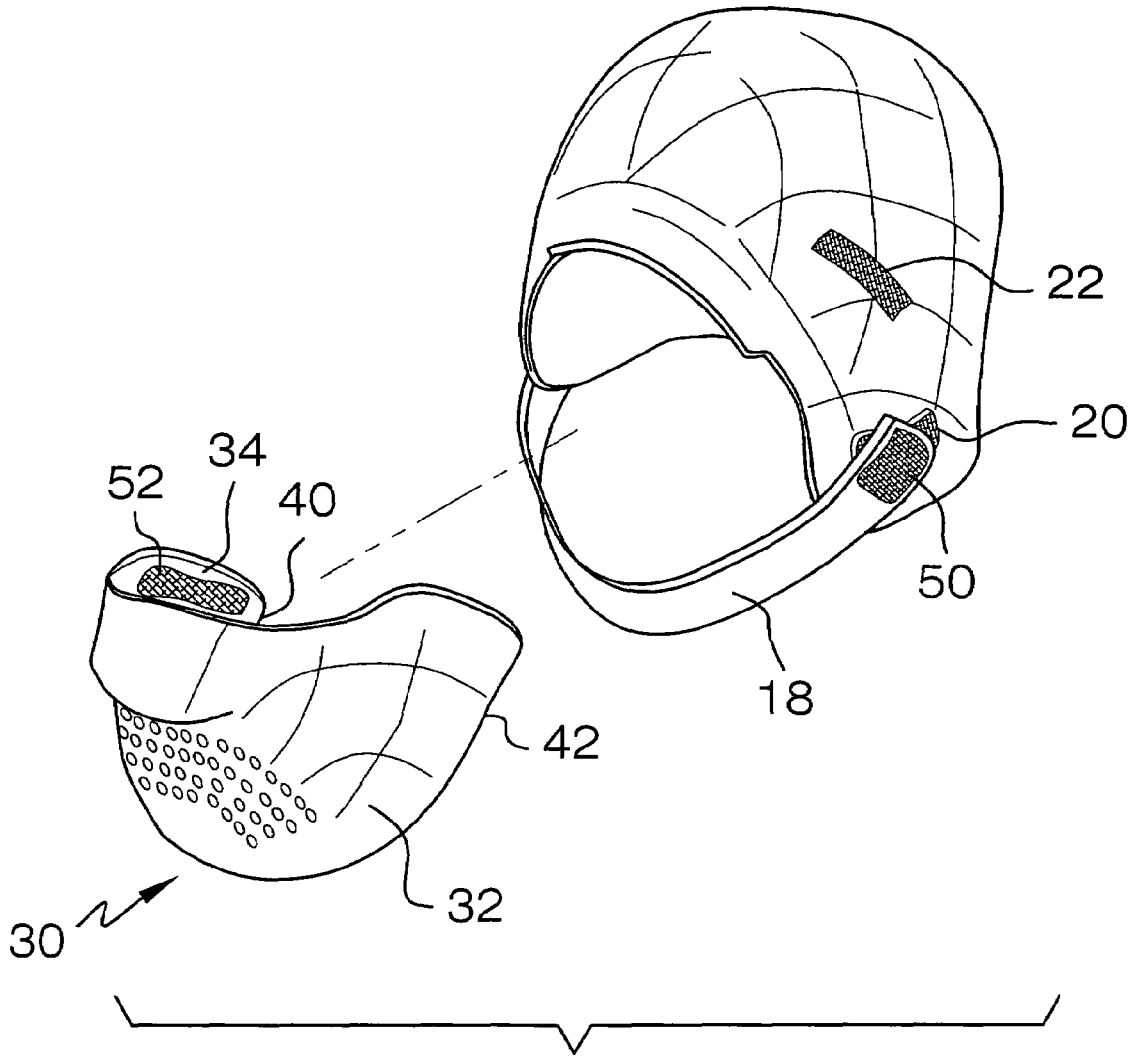
FIG. 4 is a perspective view of the present invention.

With reference now to the drawings, and in particular to FIGS. 1 through 4 thereof, a new facemask device embodying the principles and concepts of the present invention and generally designated by the reference numeral 10 will be described.

As best illustrated in FIGS. 1 through 4, the facemask assembly 10 is removably attachable to a hardhat liner 12. The hardhat liner 12 has an upper wall 14 and a pair of side walls 16. A strap 18 is removably attached to and extends between the side walls 16. The strap 18 is attached to an outer surface of the side walls 16 with a hook and loop apparatus 20. The hardhat liner 12 may also be attached to a hardhat using a hook and loop apparatus 22.

The facemask assembly 10 generally comprises a panel 30 that has a front side 32, a back side 34, a bottom edge 36, an upper edge 38, a first lateral edge 40 and a second lateral edge 42. The panel 30 is comprised of a conventional insulating cloth material. The front side 32 has a generally convex shape. The panel 30 has a plurality of apertures 44 extending therethrough. The apertures 44 are positioned generally between the first and second lateral edges and nearer to the bottom edge 36 than the upper edge 38. Each of the apertures 44 has a perimeter edge having a length less than 2.0 inches. The panel 30 has an outwardly extending portion 46 positioned adjacent to the upper edge and positioned between the first 40 and second 44 lateral edges. The outwardly extending portion 46 defines a nose receiving cavity.

A securing apparatus is attached to the panel 30 and is configured to releasably secure the back side 34 of the panel 30 to an outer surface of the strap 18. The securing apparatus comprises a pair of first mating members 50 and a pair of second mating members 52. Each of the first mating members 50 is attached to an outer surface of the strap 18 and each is positioned adjacent to one of a pair of outer ends of the strap 18. The second mating portions 52 are attached to the back side 34 and each of the second mating portions 52 is positioned adjacent to one of the first 40 and second 42 lateral edges. The securing apparatus preferably comprises a hook and loop securing apparatus though snaps may also be used.

In use, the liner 12 is placed in a hardhat and attached thereto in a conventional manner. The panel 30, when needed, is attached to the liner 12 as discussed above and shown in FIG. 1 to protect a worker's face from the elements.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A facemask assembly, said assembly being removably attachable to a hardhat liner, the hardhat liner having an upper wall and a pair of side walls, a strap being removably attached to and extending between the side walls, the strap being attached to an outer surface of the side walls with a hook and loop apparatus, said assembly comprising:

a panel having a front side, a back side, a bottom edge, an upper edge, a first lateral edge and a second lateral edge, said panel being comprised of an insulating cloth material, said front side having a generally convex shape, said panel having a plurality of apertures extending therethrough, said apertures being positioned generally between said first and second lateral edges and nearer to said bottom edge than said upper edge; and a securing apparatus being attached to said panel and being configured to releasably secure said back side of said panel to an outer surface of the strap, said securing apparatus comprising a pair of first mating members and a pair of second mating members, each of said first mating members being attached to an outer surface of the strap and each being positioned adjacent to one of a pair of outer ends of the strap, each of said second mating portions being attached to said back side and each of said second mating portions being positioned adjacent to one of said first and second lateral edges.

2. The assembly according to claim 1, wherein each of said apertures having a perimeter edge having a length less than 2.0 inches.

3. The assembly according to claim 1, wherein said panel has an outwardly extending portion positioned adjacent to said upper edge and positioned between said first and second lateral edges, said outwardly extending portion defining a nose receiving cavity.

4. The assembly according to claim 1, wherein said securing apparatus comprises a hook and loop securing apparatus.

5. A facemask assembly, said assembly being removably attachable to a hardhat liner, the hardhat liner having an upper wall and a pair of side walls, a strap being removably attached to and extending between the side walls, the strap being attached to an outer surface of the side walls with a hook and loop apparatus, said assembly comprising:

a panel having a front side, a back side, a bottom edge, an upper edge, a first lateral edge and a second lateral edge, said panel being comprised of an insulating cloth material, said front side having a generally convex shape, said panel having a plurality of apertures extending therethrough, said apertures being positioned generally between said first and second lateral edges and nearer to said bottom edge than said upper edge, each of said apertures having a perimeter edge having a length less than 2.0 inches, said panel having an outwardly extending portion positioned adjacent to said upper edge and positioned between said first and second lateral edges, said outwardly extending portion defining a nose receiving cavity;

a securing apparatus being attached to said panel and being configured to releasably secure said back side of said panel to an outer surface of the strap, said securing apparatus comprising a pair of first mating members and a pair of second mating members, each of said first mating members being attached to an outer surface of the strap and each being positioned adjacent to one of a pair of outer ends of the strap, each of said second mating portions being attached to said back side and each of said second mating portions being positioned adjacent to one of said first and second lateral edges, said securing apparatus comprising a hook and loop securing apparatus.

* * * * *